US006220334B1

(12) United States Patent
Tomita et al.

(10) Patent No.: US 6,220,334 B1
(45) Date of Patent: Apr. 24, 2001

(54) PROCESS FOR WASHING MOLDING DIE FOR COLD BOX PROCESS AND WASHING APPARATUS THEREFOR

(75) Inventors: Munekatsu Tomita; Haruyoshi Hirano; Hideaki Shimizu; Hidetoshi Nakamura, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/199,727

(22) Filed: Nov. 25, 1998

(30) Foreign Application Priority Data

Nov. 26, 1997 (JP) ..... 9-324144

(51) Int. Cl.[7] ..... B08B 3/02; B22C 19/00

(52) U.S. Cl. ..... 164/121; 164/158; 134/102.2; 134/107

(58) Field of Search ..... 164/158, 121; 134/34, 35, 102.2, 107

(56) References Cited

U.S. PATENT DOCUMENTS 5,126,089 6/1992 Johnson et al. .

5,544,667 8/1996 Landua et al. .

FOREIGN PATENT DOCUMENTS

| | | | |
|---|---|---|---|
| 0 302 616 B1 | 3/1993 | (EP) . | |
| 58-173077 | 10/1983 | (JP) . | |
| 07136602 | 5/1995 | (JP) . | |
| 485818 * | 2/1976 | (RU) | 164/158 |
| 1 118 479 | 10/1984 | (SU) . | |

OTHER PUBLICATIONS

D.M. Stefanescu et al., "Metals Handbook, vol. 15, Casting" 1988, ASM International, Ohio US XP002095989, pp. 238–241, Wile, L.E., et al., entitled "Coremaking".

* cited by examiner

*Primary Examiner*—Kuang Y. Lin
(74) *Attorney, Agent, or Firm*—Morgan & Finnegan, L.L.P.

(57) ABSTRACT

A molding die for a cold box process is opened after usage. Washing water is heated at a temperature of 70° C. or more, and is blown to a molding surface of the molding die at a high pressure of 10 MPa or more. The cold-box-process molding die can be washed by this process easily and fully.

6 Claims, 8 Drawing Sheets

WASHABILITY
10
5
0
7.84
9.80
14.7(MPa)
PRESSURE

WASHABILITY
10
5
0
7.84
9.80
14.7(MPa)
PRESSURE

WASHABILITY
10
5
0
7.84
9.80
14.7(MPa)
PRESSURE

PROCESS FOR WASHING MOLDING DIE FOR COLD BOX PROCESS AND WASHING APPARATUS THEREFOR

BACKGROUND OF THE INVENTION

1. Field of the Invention

The present invention relates to a process for washing a molding die for preparing a casting die (or core), and an apparatus therefor. In particular, the casting die (or core) is prepared by a cold box process.

2. Description of the Related Art

In a cold box process, a mixture of a phenol resin composition and a polisocyanate is compounded with a casting silica sand to prepare a casting sand. The resulting casting sand is filled in a molding die. Then, a TEA (i.e., triethylamine) gas is introduced into the molding die. Accordingly, a polyurethane resin arises to work as a bonding agent. The bonding agent can be cared at an ordinary temperature. Thus, a casting die (or core) can be prepared precisely in accordance with a cavity of the molding die. After molding the casting die by the cold box process, the bonding agent and silica sand reside on a molding surface and in a vent hole. The molding surface forms the cavity, and the vent holes are opened in the molding surface. Consequently, it is necessary to remove the bonding agent and silica sand when another high-quality casting die should be molded by reusing the molding die.

Conventionally, the following 3 washing processes have been employed to wash the molding die:

(a) brushing the molding die with a metallic brush together with an organic solvent;

(b) blowing the molding die with highly pressurized air together with an organic solvent; and (c) blowing the molding die with shot particles made from glass or stainless steel, or with sand.

However, it is difficult to remove the bonding agent and silica sand from the molding die by the aforementioned conventional washing processes. Especially, it is difficult to remove them from narrow or congested areas. Accordingly, it is necessary to manually carry out the washing operation by an operator. In addition, it is needed to frequently carry out the removing operation, and it is inevitable that the time required for the operation should be prolonged. Moreover, even if an organic solvent is used in the conventional washing processes, the organic solvent might adversely affect ejector pins, etc., of the molding die, depending on the types of the organic solvent employed.

In particular, the vent hole cannot be processed effectively by the first and second conventional washing processes (a) and (b). Even if the vent holes are processed by the third convention al washing process (c), the molding surface around the vent hole might be damaged, and a mesh, which is usually provided for the vent hole, might be damaged. Moreover, the mesh might make it difficult to recover the glass particles, etc. Consequently, the mesh, etc., should be replaced with new ones regularly under the current circumstances.

SUMMARY OF THE INVENTION

The present invention has been developed in view of the aforementioned circumstances. It is therefor e an object of the present invention to provide a process and an apparatus for washing a molding die for a cold box process easily and fully.

The invent ors of the present invention ma de research and development extensively in order to achieve the object. First of all, they started investigating the chemical processes (1) through (21) as listed in Table 1 through Table 1 (sexies) below, and the physical processes (22) through (31) as listed in Table 2 through Table 2 (quarter) below.

TABLE 1

| Chemical Washing | Water Soluble Washing Agent |
|---|---|
| (1) | Pure Water or Ultra-pure Water |
| (2) | Alkali Aqueous Solution |
| (3) | Surfactant Aqueous Solution |
| (4) | Surfactant/Alkali Combined Aqueous Solution |
| (5) | Surfactant/Organic Solvent Combined Aqueous Solution |

TABLE 1 (bis)

| Chemical Washing | Organic Solvent Washing Agent |
|---|---|
| (6) | Chlorinated Solvent |
| (7) | Hydrocarbon-based Solvent |
| (8) | Silicone-based Solvent |
| (9) | Alcohol-based Solvent |

TABLE 1 (ter)

| Chemical Washing | Washing Mode |
|---|---|
| (10) | Electrolysis Washing with Alkali Aqueous Solution |
| (11) | Ultrasonic Washing |
| (12) | Rotary Brush Washing |
| (13) | Immersion-oscillation Washing |
| (14) | Spraying Washing |
| (15) | Bubbling Washing |

TABLE 1 (quater)

| Heating | Conduction Heat |
|---|---|
| (16) | Combustion Mode |
| (17) | Steam Mode |

TABLE 1 (quiquies)

| Heating | Radiation Heat |
|---|---|
| (18) | UV Light Mode |
| (19) | Plasma Mode |

TABLE 1 (sexies)

| Chemical Reaction | Oxidation |
|---|---|
| (20) | Dry Ozone Oxidation Mode |
| (21) | Wet Ozone Oxidation Mode |

TABLE 2

| Physical Washing by Shots | Permanent Solid |
|---|---|
| (22) | Sand |
| (23) | Plastic Particles |
| (23) | Glass Particles |
| (24) | Stainless Steel Particles |

TABLE 2 (bis)

| Physical Washing by Shots | Disappearing Substance |
|---|---|
| (26) | Dry Ice |
| (27) | Air |

TABLE 2 (ter)

| Physical Washing by Shots | Water-related Substance |
|---|---|
| (28) | Ice |
| (29) | Highly-pressurized Water |

TABLE 2-continued

TABLE 2 (quater)

| Physical Washing by Brush | Washing Mode |
|---|---|
| (30) | Jet-like-propelled Chisel |
| (31) | Electromotive Brush |

Chemical processes (1) through (21), and physical processes (22) through (31) were evaluated in terms of quality, difficulty, washability, cost and safety. They were graded as "Excellent", "Good", "Fair" or "Poor" for the characteristics, and were rated in terms of overall performance as well. Note that, in the evaluation, the quality was determined based on the presence of abrasion, etc., on a molding surface of a molding die, and the quality resulted in the superiority or inferiority of a resulting casting die. The casting die was prepared herein by the molding die which had been subjected to the washing processes. Table 3 below summarizes the results of the evaluation on the chemical processes (1) through (21). Table 4 below summarizes the results of the evaluation on the physical processes (22) through (31).

TABLE 3

| | Quality | Difficulty | Washability | Cost | Safety | Overall Evaluation |
|---|---|---|---|---|---|---|
| (1) | Fair | Excellent | Poor | Excellent | Excellent | Fair |
| (2) | Fair | Excellent | Good | Good | Fair | Good |
| (3) | Fair | Good | Fair | Good | Good | Fair |
| (4) | Fair | Good | Fair | Fair | Fair | Fair |
| (5) | Good | Good | Good | Fair | Fair | Fair |
| (6) | Poor | Good | Good | Fair | Poor | Fair |
| (7) | Good | Good | Good | Fair | Fair | Good |
| (8) | Good | Good | Fair | Poor | Fair | Poor |
| (9) | Good | Good | Fair | Fair | Fair | Fair |
| (10) | Fair | Fair | Fair | Fair | Fair | Fair |
| (11) | Good | Good | Good | Poor | Good | Good |
| (12) | Fair | Fair | Fair | Poor | Fair | Poor |
| (13) | Good | Good | Fair | Fair | Fair | Good |
| (14) | Good | Good | Fair | Fair | Fair | Good |
| (15) | Good | Good | Fair | Fair | Good | Good |
| (16) | Poor | Excellent | Excellent | Good | Poor | Poor |
| (17) | Fair | Excellent | Fair | Good | Good | Good |
| (18) | Fair | Good | Fair | Poor | Fair | Fair |
| (19) | Poor | Fair | Poor | Poor | Poor | Poor |
| (20) | Good | Fair | Fair | Poor | Poor | Fair |
| (21) | Fair | Fair | Good | Poor | Poor | Fair |

TABLE 4

| | Quality | Difficulty | Washability | Cost | Safety | Overall Evaluation |
|---|---|---|---|---|---|---|
| (22) | Poor | Excellent | Good | Good | Fair | Fair |
| (23) | Poor | Good | Poor | Poor | Good | Poor |
| (24) | Fair | Fair | Fair | Fair | Good | Fair |
| (25) | Poor | Good | Fair | Good | Good | Fair |
| (26) | Excellent | Fair | Good | Fair | Good | Good |
| (27) | Good | Excellent | Poor | Fair | Good | Fair |
| (28) | Poor | Poor | Good | Good | Good | Fair |
| (29) | Fair | Good | Fair | Good | Good | Good |
| (30) | Poor | Fair | Fair | Good | Good | Fair |

TABLE 4-continued

| | Quality | Difficulty | Washability | Cost | Safety | Overall Evaluation |
|---|---|---|---|---|---|---|
| (31) | Poor | Fair | Fair | Good | Good | Fair |

In physical process (26), the dry ice was blown to the molding surface at a high pressure. Physical process (26) was graded as "Excellent", because no problem arose in the molding surface. However, the mesh provided for the vent hole were damaged, and should be replaced with a new one.

Further, in order to investigate the washing agent in detail, the inventors of the present invention examined a washing agent "TOYOKNOCK" produced by TOYOTA KAGAKU KOGYO CO., LTD. The washing agent worked as an alkali aqueous washing liquid. Furthermore, the present inventors examined hexane, toluene, dichloromethane, heptane, methanol and acetone. The hexane and heptane worked as a paraffin-based organic solvent. The toluene worked as an aromatic organic solvent. The dichloromethane worked as a chlorinated hydrocarbon organic solvent. The methanol worked as an alcohol-based organic solvent. The acetone worked as a ketone-based organic solvent. Among the aforementioned organic solvents, the hexane showed somewhat satisfactory results in terms of the washing ability for the molding surface when it is pressurized to a pressure exerted by an ordinary shower. However, the hexane showed still unsatisfactory results in terms of the washing ability for the vent hole. Note that the aforementioned organic solvents are quite unsatisfactory in terms of the safety because they were poisonous or dangerous substances.

Hence, the inventors of the present invention aimed at making the pure water or ultra-pure water a washing liquid. They further continued research and development to give the pure water or ultra-pure water a more general purpose applicability. As a result, they completed the present invention as hereinafter described.

A washing process according to the present invention comprises the step of opening a molding die for a cold box process after usage, the molding die including a molding surface, and blowing washing water on the molding surface at a high pressure of 10 MPa or more, the washing water heated at a temperature of 70° C. or more.

In the present washing process, distilled water, tap water and tap water containing a rust prevention agent can be used as the washing water. It is preferred to recycle the washing water by collecting and filtering the washing water after the blowing operation.

Since the present washing process employs the washing water, the narrow areas of the molding die can be washed with ease. When carrying out the present washing process, the washing water is heated at a temperature of 70° C. or more and blown at a high pressure of 10 MPa or more. As a result, the bonding agent and silica sand can be removed remarkably effectively. The advantage can be verified by the evaluation tests carried out by the present inventors. Thus, the present washing process is practical. In the present washing process, it is preferred to heat the washing water at a temperature of from 70 to 90° C., and to blow the washing water at a high pressure of from 10 to 15 MPa.

Accordingly, the present washing process can shorten the time required for removing the bonding agent and silica sand, and can easily automate the removing operation by using a robot, etc. The washing water employed by the present washing process hardly affects the ejector pins, etc., of the molding die adversely, little abrades the molding surface and scarcely damages the mesh provided for the vent hole. Moreover, the washing water can be collected with ease.

In a further aspect of the present washing process, the opened molding die can preferably be tilted, thereby inhibiting the washing water from residing in the molding surface. With this arrangement, the washing water can be inhibited from blowing on the molding surface in which the washing water is resided. Consequently, the fresh washing water can be blown on the molding surface anew. Thus, the temperature and pressure of the washing water can be maintained so that the bonding agent and silica sand can be removed highly effectively.

In a further aspect of the present washing process, the washing water can preferably be blown on the molding surface of the opened molding die at varying blowing angles. The molding surface is formed as a variety of configurations corresponding to a diversity of casting dies. Accordingly, with this arrangement, the washing water can be blown on spacious areas of the molding die at a wide angle so that the bonding agent, etc., can be removed in a shortened period of time. In addition, the washing water can be blown on narrow areas of the molding die at a narrow angle so that the bonding agent, etc., can be removed securely.

The present washing process can preferably further comprise the step of blowing highly pressurized air on the molding surface of the opened molding die after blowing the washing water thereto. With this arrangement, the washing water little resides in the molding surface. Consequently, the molding surface can be inhibited from rusting.

In a further aspect of the present washing process, the washing water can preferably be recycled after washing the molding surface of the opened molding die, and can preferably be filtered to reuse for the washing process. With this arrangement, the washing water can be saved by recycling it.

A washing apparatus according to the present invention comprises:

- a holding unit for holding an opened molding die for a cold box process after usage therein, the molding die including a molding surface;
- a reservoir unit for reserving washing water therein;
- a heating unit for heating the washing water reserved in the reservoir unit;
- a pressurizing unit for pressuring the washing water reserved in the reservoir unit;
- a blowing unit or blowing the washing water to the molding surface of the molding die held in the holding unit, the washing water heated at a temperature of 70° C. or more and pressurized to a high pressure of 10 MPa or more, the blowing unit connected with the reservoir unit;
- a circulating unit for collecting the washing water after the blowing operation and circulating the washing water to the reservoir unit; and
- a filtering unit for filtering the washing water after the blowing operation.

In a farther aspect of the present washing apparatus, the blowing unit can preferably be held down from a ceiling. The highly pressurized washing water reflects back from the molding surface, and accordingly is likely to reside under the blowing unit as well. Hence, when the blowing unit is held down from a ceiling, the blowing unit is hardly immersed in the washing water. Consequently, the blowing unit can be inhibited from rusting.

As having described so far, in accordance with the present washing process and washing apparatus, the cold-box-process molding die can be washed easily and fully.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 6 illustrates the results of Evaluation Test No. 1, wherein:

FIG. 7 illustrates the results of Evaluation Test No. 2, wherein:

FIG. 8 illustrates the results of Evaluation Test No. 3, wherein:

DETAILED DESCRIPTION OF THE PREFERRED EMBODIMENTS

Having generally described the present invention, a further understanding can be obtained by reference to the specific preferred embodiments which are provided herein for the purpose of illustration only and not intended to limit the scope of the appended claims.

The present invention will be hereinafter described in detail with reference to a Preferred Embodiment exemplifying the present invention, the results of Evaluation Test Nos. 1 through 3 and the accompanying drawings.

Preferred Embodiment

Figure 1:
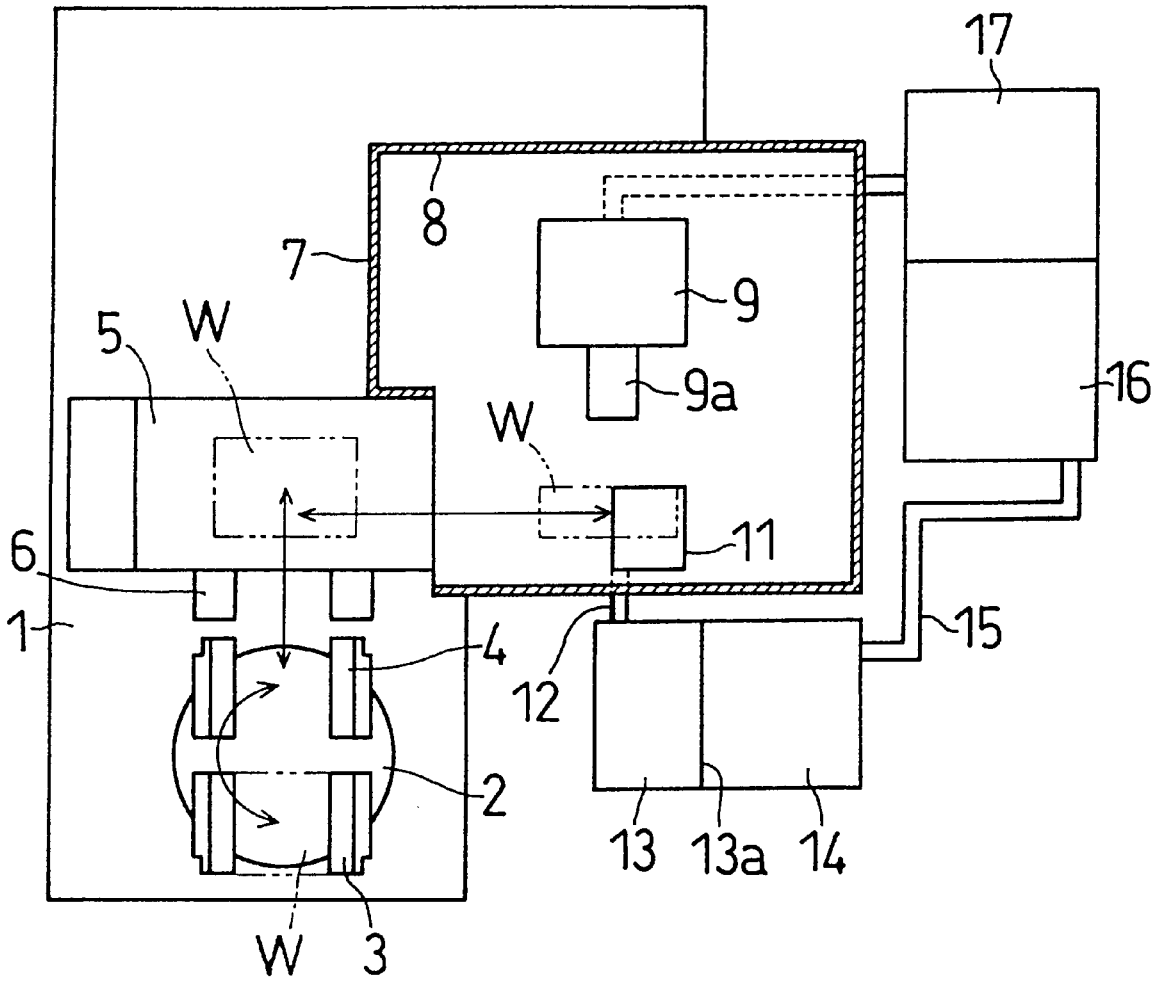
FIG. 1 illustrates a washing apparatus of a Preferred Embodiment according to the present invention, and is a schematic plan view for showing the washing apparatus partly in horizontal cross-section.

First of all, a washing apparatus of a Preferred Embodiment according to the present will be described in detail. As illustrated in FIG. 1, the washing apparatus comprises a base 1, a turntable 2, a holding unit 5, rollers 3 and 4, and rollers 6. The turntable 2 is disposed on the base 1. A molding die "W" for a cold box process is placed on the turntable 2. The rollers 3 and 4 transfer the molding die "W" from the inside to the outside, or from the outside to the inside. Another molding die "W" is placed in the rear of the turntable 2, another molding die "W" which has been transferred by the rollers 3 and 4 previously. The rollers 6 transfer the molding die "W" to the holding unit 5 forward, or from the holding unit 5 rearward. The turntable 2, the rollers 3 and 4, and the rollers 6 herein constitute a transferring unit.

Figure 3:
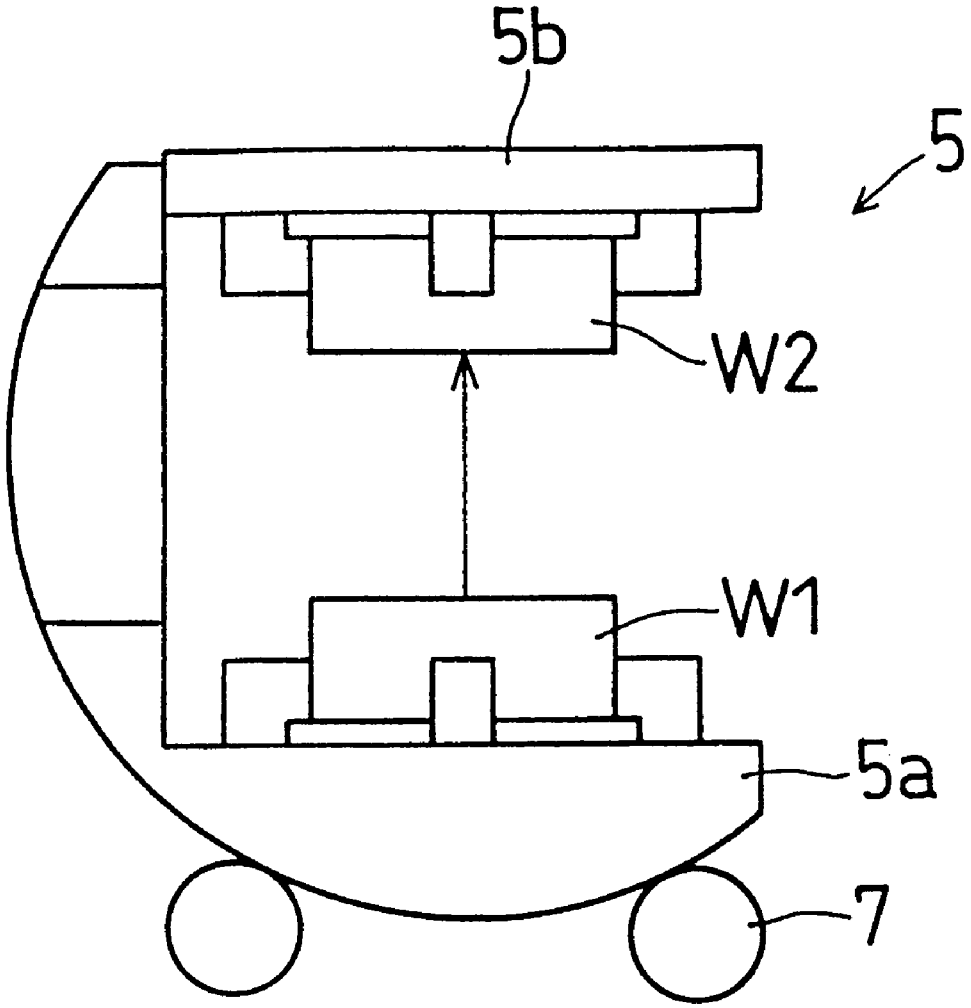
FIG. 3 illustrates the washing apparatus of the Preferred Embodiment, and is a schematic side view for showing a holding unit of the washing apparatus in the course of opening a molding die.
Figure 4:
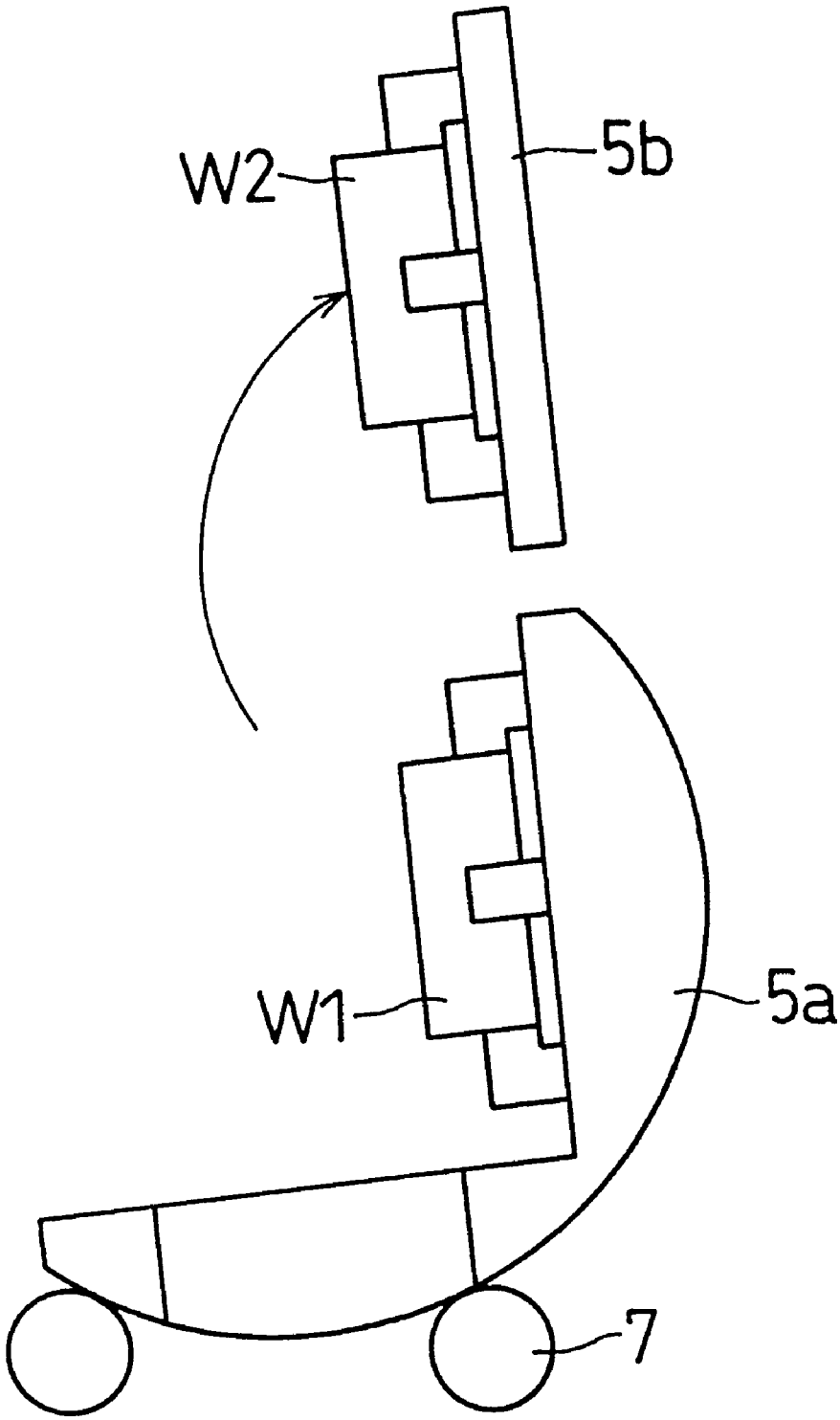
FIG. 4 illustrates the washing apparatus of the Preferred Embodiment, and is a schematic side view for showing the holding unit which holds the opened molding die.

As illustrated in FIGS. 3 and 4, the holding unit 5 includes a cradle 5*a*, and a cramp 5*b*. The cradle 5*a* holds a lower die "W1" of the molding die "W". As shown in FIG. 4, rollers 7 swing the cradle 5*a* in the counter clockwise direction in the drawing, thereby inverting the lower die "W1" by about 95 deg. The cramp 5*b* holds an upper die "W2" of the molding die "W". As shown in FIG. 4, a shaft (not shown) swings the cramp 5*b* in the clockwise direction in the drawing, thereby inverting the upper die "W2" by about 85 deg.

Figure 5:
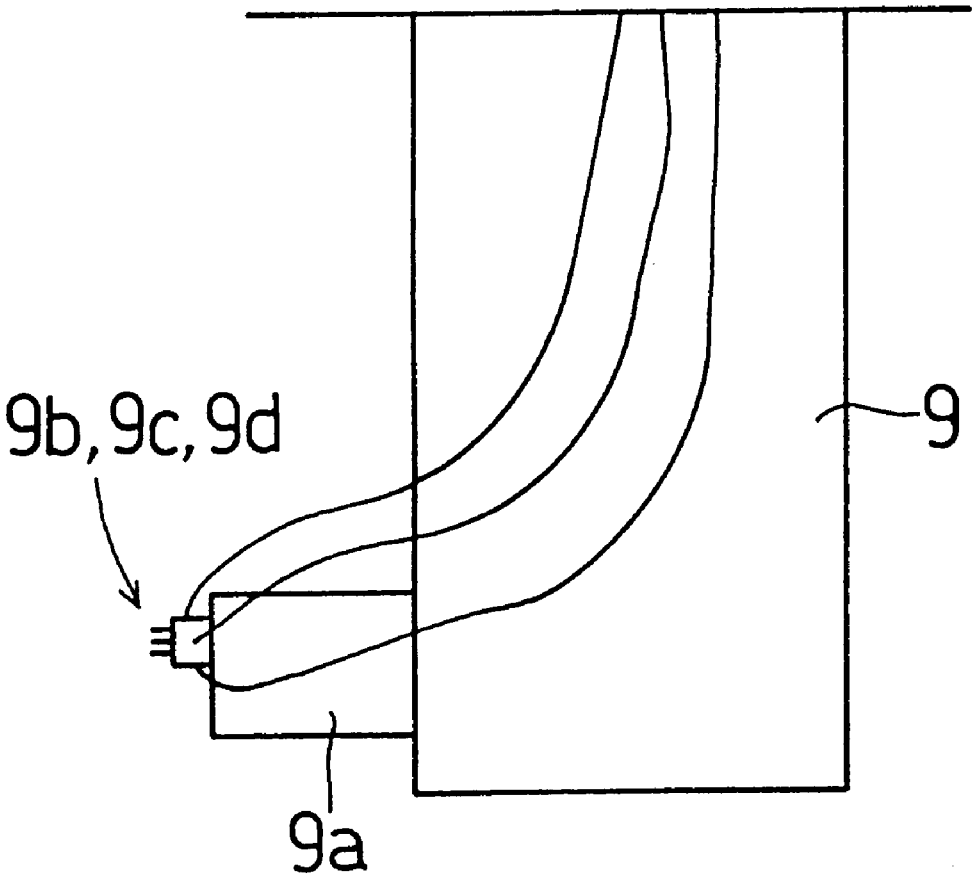
FIG. 5 illustrates the washing apparatus of the Preferred Embodiment, and is a schematic side view for showing a blowing unit of the washing apparatus.

As illustrated in FIG. 1, a washing booth 8 is formed on one side of the holding unit 5. The washing booth 8 includes partition walls 7. The holding unit 5 is made movable in and out of the washing booth 8 by a carriage (not shown). As shown in FIG. 5, a blowing robot 9 is held down from a ceiling in the washing booth 8. The blowing robot 9 works as a blowing unit. The robot 9 includes a robot arm 9*a*. In the robot arm 9*a*, there are disposed a direct injection nozzle 9*b*, a wide-angle nozzle 9*c*, and an air nozzle 9*d*. The direct injection nozzle 9*b* can blow washing water at a blowing angle of 0 deg. with respect to a molding surface of the molding die "W" by way of a control valve 10 (shown in FIG. 2). The wide-angle nozzle 9*c* can blow the washing water at a blowing angle of 90 deg. with respect to a molding surface of the molding die "W" by way of the control valve 10. The air nozzle 9*f* can blow highly Pressurized air to a molding surface of the molding die "W" by way of an air supplying unit (shown in FIG. 2).

Further, as illustrated in FIG. 1, the ceiling of the washing booth 8 is provided with a blower 11. The blower 11 can evacuate the steam, which results from the washing water, to the outside. The floor of the washing booth 8 is provided with a drain opening (not shown). The drain opening is connected with a dirty tank 13 by way of a pipe 12 and a filter (not shown). The filter has a mesh size of 40. The dirty tank 13 has a capacity of 120 L. In the dirty tank 13, the oil is separated from the washing water. The dirty tank 13 is connected with a clean tank 14. The clean tank 14 has a capacity of 212 L. A cloth filter 13*a* is disposed between the dirty tank 13 and the clean tank 14, and is changeable one after another. Accordingly, the collected washing water is supplied from the dirty tank 13 to the clean tank 14 consecutively. A valve (not shown) is further disposed in a communication hole between the dirty tank 13 and clean tank 14. The valve opens the communication hole as the washing-water level decreases in the clean tank 14. The clean tank 14 originally holds the washing water including tap water therein. A temperature-controlling heater (not shown) is further disposed in the clean tank 14. The heater keeps the washing water held in the clean tank 14 at about 60° C. The clean tank 14 is connected with a high-pressure plunger pump 16 by way of a pipe 15 and another filter. The high-pressure plunger pump 16 is provided for pressurizing and delivering the washing water. The high-pressure plunger pump 16 is connected with the control valve 10 so as to place its outlet aperture adjacent to a flame outlet aperture of a gas burner 17. Moreover, an air-pressurizing unit 18 (shown in FIG. 2) is further connected with the blowing robot 9 by way of another valve (shown in FIG. 2). The air-pressurizing unit 18 is provided to pressurize air to blow away the washing water. The dirty tank 13, and the clean tank 14 herein constitute a reservoir unit. The temperature-controlling heater, and the gas burner 17 herein constitute a heating unit. The high-pressure plunger pump 16 herein constitutes a washing-water pressurizing unit. The blower 11, the drain opening, the pipe 12, and the pipe 15 herein constitute a circulating unit. The filter cloth 13*a*, and the filter (not shown) herein constitute a filtering unit.

Figure 2:
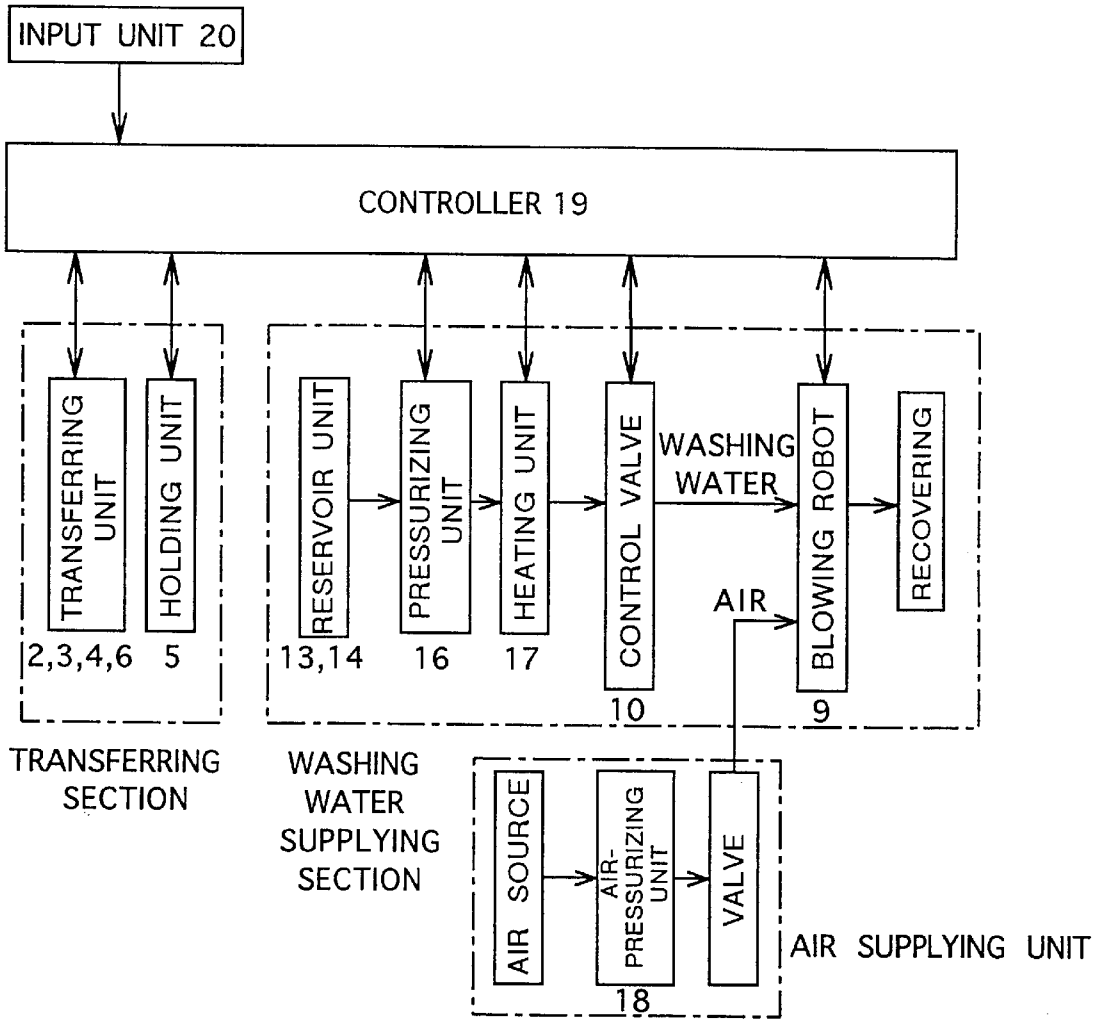
FIG. 2 illustrates the washing apparatus of the Preferred Embodiment, and is a schematic block diagram for showing the constituent units of the washing apparatus.

As illustrated in FIG. 2, the turntable 2, the rollers 3 and 4, and the rollers 6, constitute the transferring unit, and are connected with a controller 19 disposed in a control panel (not shown). The holding unit 5 is connected with the controller 19. The gas burner 17, etc., constitute the heating unit, and are connected with the controller 19. The high-pressure plunger pump 16 constitutes the washing-water pressurizing unit, and is connected with the controller 19. Likewise, the control valve 10, the air-pressurizing unit 18, and the blowing robot 9 are connected with the controller 19. The controller 19 is further connected with an input unit 20 including switches.

The thus constructed washing apparatus is used to wash the molding die "W". The molding die "W" has been used to prepare a core by a cold box process. At first, as illustrated in FIG. 1, an operator places the molding die "W" on the rollers 3 by using a fork-lift truck. The rollers 3 are disposed on the turntable 2. Then, the operator turns on the switches of the input unit 20. Consequently, the controller 19 actuates the washing apparatus to carry out the following operations in accordance with a predetermined program.

First of all, a molding die "W" is transferred by the rollers 3 from the outside to the inside, and is turned by the turntable 2. Thereafter, the molding die "W" is transferred by the rollers 3 from the inside to the outside, and is further transferred by the rollers 6 to the holding unit 5 forward. When the turntable 2 is thus turned, another molding die OWN can be placed on the rollers 4. Accordingly, while the molding die "W" is washed, the other molding die "W" can be put into a stand-by state for the next washing operation.

Then, as illustrated in FIG. 3, the molding die "W" is opened. Specifically, the lower die "W1" is held by the cradle 5*a*, and the upper die "W2" is held and pulled up by the cramp 5*b*. Thereafter, as illustrated in FIG. 4, the lower die "W1" is inverted by about 95 deg, and the upper die "W2" is inverted by about 85 deg. While keeping the molding die "W" thus open, the holding unit 5 is moved into the washing booth 8.

Further, the washing water is blown by the blowing robot 9 to the molding surface of the opened molding die "W". As earlier mentioned, the washing water is heated at a temperature of 70° C. or more, and is pressurized at a high pressure of 10 MPa or more. In the washing-water blowing operation, the wide-angle nozzle 9*c* blows the washing water at a broad angle to the spacious areas of the molding die "W" so as to remove the bonding agent, etc., in a short period of time; and the direct injection nozzle 9*b* blows the washing water at a narrow angle to the narrow areas of the molding die "W" so as to securely remove the bonding agent, etc. Moreover, the opened molding die "W" is held and tilted by the holding unit 5. Consequently, the washing water is inhibited from residing in the molding surface, and the fresh washing water is blown to the molding surface anew. Therefore, the temperature and pressure of the washing water can be maintained so that the bonding agent, etc., can be removed highly effectively. Thus, by employing the thus arranged preferred washing apparatus or process of the present invention, the narrow areas of the molding die "W" can be washed with ease. In addition, the blowing robot 9 can be inhibited from being immersed in the washing water, because it is held down from the ceiling. Hence, the blowing robot 9 can be inhibited from rusting.

Furthermore, after the washing-water blowing operation, the highly pressurized air is blown to the molding surface of the molding die "W" by the air nozzle 9*d*. As described above, the air-pressurizing unit 18 pressurizes air to a high pressure. Consequently, the washing water is blown off from the molding surface. Thus, the molding surface can be inhibited from rusting.

Moreover, after the washing operation, the washing water is collected into the dirty tank 13 by way of the drain opening and the pipe 12. Whilst, the steam resulting from the washing water is evacuated by the blower 11, and is also collected into the dirty tank 13. Then, the washing water is filtered by the filter cloth 13*a* and filter (not shown), and is recovered into the clean tank 14. Thereafter, the washing water is again heated by the temperature-controlling heater and gas burner 17, and is again highly pressurized by the high-pressure plunger pump 16. Finally, the washing water is reused for the washing operation. Hence, the washing water can be saved by recycling it.

As described so far, the washing process employing the washing apparatus of the Preferred Embodiment can shorten the time required for removing the bonding agent, etc. Since the washing process employs the washing water, the ejector pins, etc., of the molding die "W" are hardly affected adversely, the molding surface is little abraded, and the mesh, etc., provided for the vent hole are scarcely damaged. As a result, it is apparent that the washing process can wash the molding die "W" easily and fully.

Evaluation Test No. 1

Figure 6A:
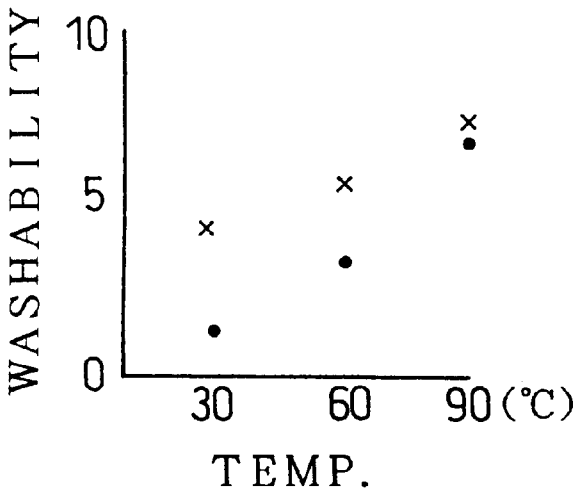
FIG. 6(A) is a scatter diagram for showing the relationship between the temperature of the washing water and the washability for a vent hole provided with a mesh.
Figure 6B:
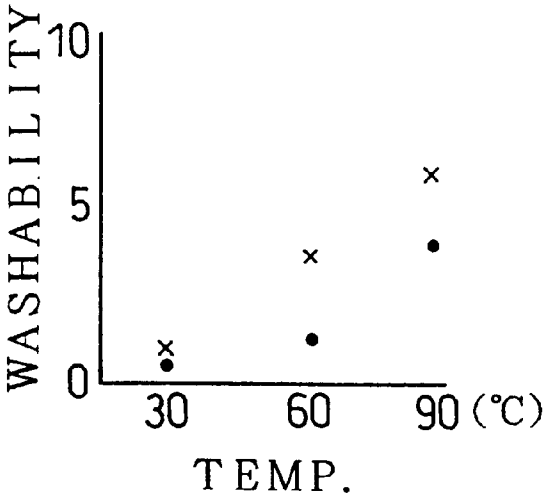
FIG. 6(B) is a scatter diagram for showing the relationship between the temperature of the washing water and the washability for a vent hole provided with a slit.
Figure 6C:
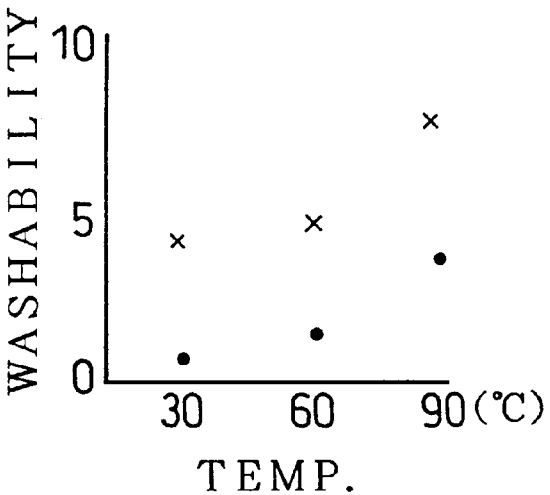
FIG. 6(C) is a scatter diagram for showing the relationship between the temperature of the washing water and the washability for a molding surface.

The washing apparatus of the Preferred Embodiment was adjusted so that it heated and blew the washing water at a temperature of 30° C., 60° C. and 90° C., respectively. The washability was inspected visually at 10 stages so as to determine the relationship between the temperature of the washing water and the washability. The results are illustrated in FIG. 6. Note that, in FIG. 6, the mark "×" specifies the results when the washing water was pressurized at 7.84 MPa and discharged in an amount of 5 L/min.; and the mark "●" specifies the results when the washing water was pressurized at 9.80 MPa and discharged in an amount of 10 L/min. FIG. 6 (A) shows the results of the washability evaluation for a vent hole provided with a mesh. FIG. 6 (B) shows the results of the washability evaluation for a vent hole provided with a slit. FIG. 6 (C) shows the results of the washability evaluation for a molding surface. Concerning the vent holes, the washability was evaluated according to their opening degrees.

It is understood from FIG. 6 that the higher the temperature of the washing water was, the better the washability was exhibited. According to the results of supplemental tests, etc., it was found practical when the washing water was heated at a temperature of 70° C. or more. The supplemental tests, etc., were carried out in addition to Evaluation Test No. 1.

Evaluation Test No. 2

Figures 7A, 7B, 7C:
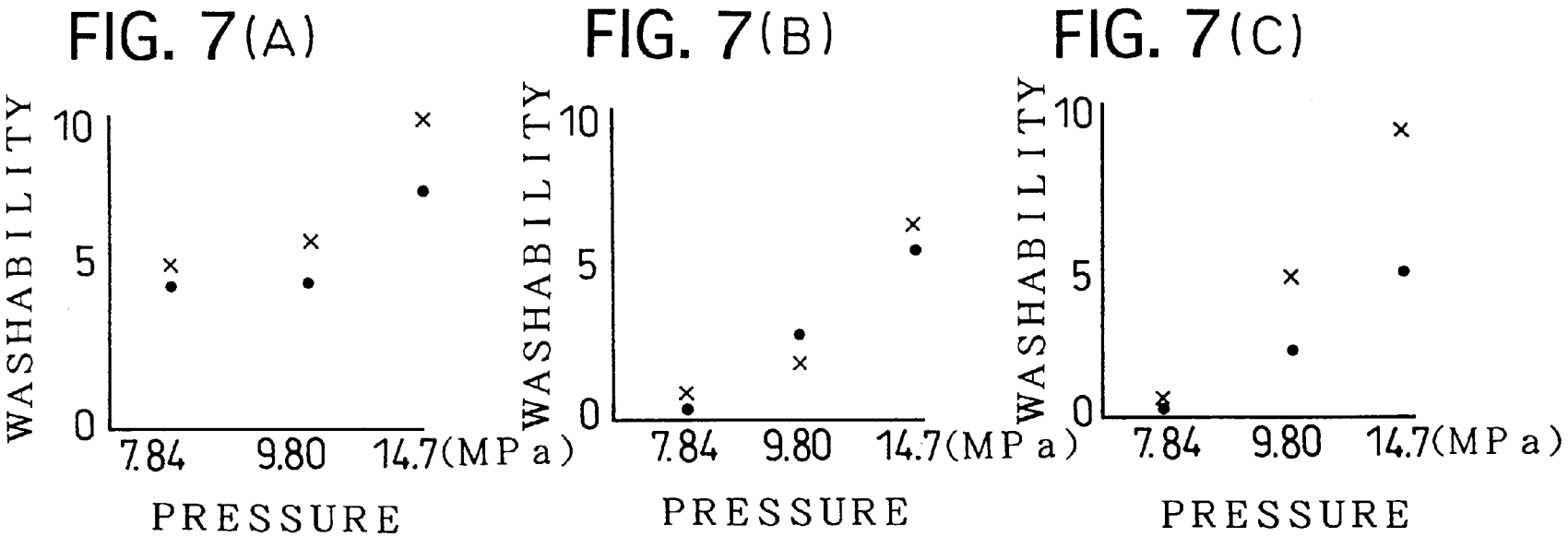
FIG. 7(A) is a scatter diagram for showing the relationship between the pressure of the washing water and the washability for a vent hole provided with a mesh.
FIG. 7(B) is a scatter diagram for showing the relationship between the pressure of the washing water and the washability for a vent hole provided with a slit.
FIG. 7(C) is a scatter diagram for showing the relationship between the pressure of the washing water and the washability fi)r a molding surface.

The washing apparatus of the Preferred Embodiment was adjusted so that it pressurized and blew the washing water at a pressure of 7.84 MPa, 9.80 MPa and 14.7 MPa, respectively. The washability was inspected visually at 10 stages so as to determine the relationship between the pressure of the washing water and the washability. The results are illustrated in FIG. 7. Note that, in FIG. 7, the mark "×" specifies the results when the washing water was heated at 90° C. and discharged in an amount of 10 L/min.; and the mark "●" specifies the results when the washing water was heated at 60° C. and discharged in an amount of 5 L/min. Except for these testing conditions, Evaluation Test No. 2 was carried out in the same manner as Evaluation Test No. 1.

It is understood from FIG. 7 that the higher the pressure of the washing water was, the better the washability was exhibited. According to the results of supplemental tests, etc., it was found practical when the washing water was pressurized at a pressure of 10 MPa or more. The supplemental tests, etc., were carried out in addition to Evaluation Test No. 2.

Evaluation Test No. 3

Figures 8A, 8B, 8C:
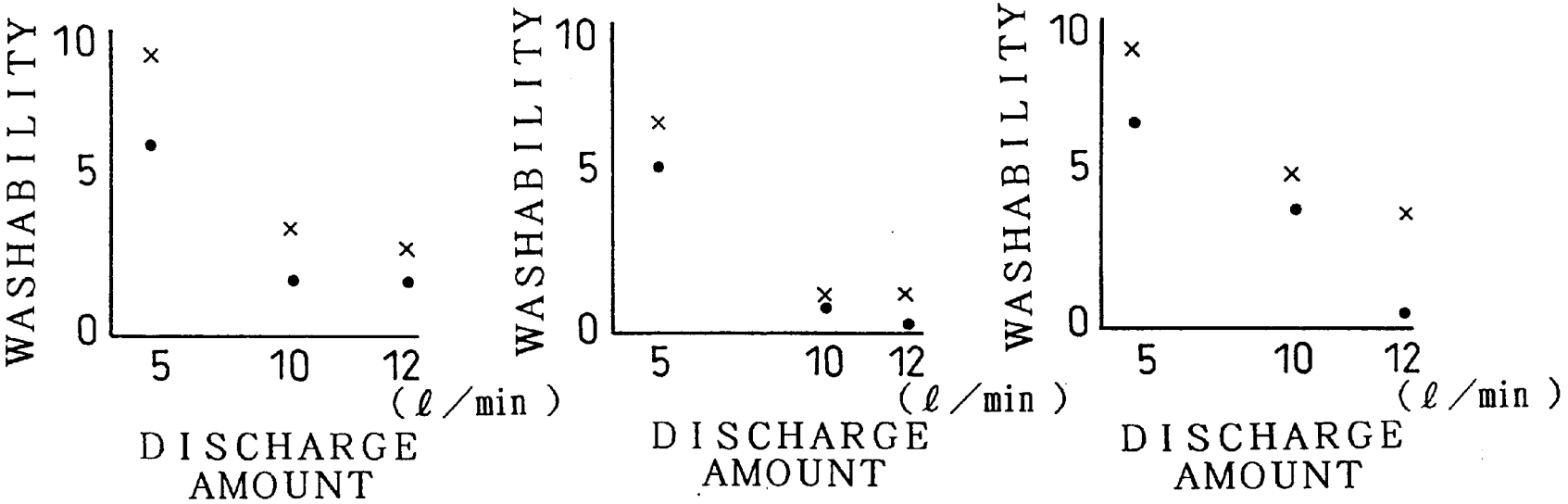
FIG. 8(A) is a scatter diagram for showing the relationship between the discharge amount of the washing water and the washability for a vent hole provided with a mesh.
FIG. 8(B) is a scatter diagram for showing the relationship between the discharge amount of the washing water and the washability for a vent hole provided with a slit.
FIG. 8(C) is a scatter diagram for showing the relationship between the discharge amount of the washing water and the washability for a molding surface.

The washing apparatus of the Preferred Embodiment was adjusted so that it discharged the washing water in an amount of 5 L/min., 10 L/min. and 12 L/min., respectively. The washability was inspected visually at 10 stages so as to determine the relationship between the discharge amount of the washing water and the washability. The results are illustrated in FIG. 8. Note that, in FIG. 8, the mark "×" specifies the results when the washing water was pressurized at 7.84 MPa and heated at 90° C.; and the mark "●" specifies the results when the washing water was pressurized at 9.80 MPa and heated at 60° C. Except for these testing conditions, Evaluation Test No. 3 was carried out in the same manner as Evaluation Test No. 1.

It is understood from FIG. 8 that the smaller the discharge amount of the washing water was, the better the washability was exhibited.

Having now fully described the present invention, it will be apparent to one of ordinary skill in the art that many changes and modifications can be made thereto without departing from the spirit or scope of the present invention as set forth herein including the appended claims.

What is claimed is:

1. A process for washing a molding surface of a molding die for a cold box process, comprising:

opening the molding die after usage, and blowing washing water onto the molding surface at a pressure of 10 Mpa or more, the washing water having a temperature of 70° C. or more.

2. The process according to claim 1, wherein the opened molding die is tilted, thereby inhibiting the washing water from residing in the molding surface.

3. The process according to claim 1, wherein the washing water is blown to the molding surface of the opened molding die at varying blowing angles.

4. The process according to claim 1 further comprising the step of blowing highly pressurized air to the molding surface of the opened molding die after blowing the washing water thereto.

5. The process according to claim 1, wherein the washing water is recycled after washing the molding surface of the opened molding die, and is filtered to reuse for the washing process.

6. A process for washing a molding surface of a molding die, comprising:

heating washing water to a temperature of at least about 70° C.;

pressurizing said washing water to a pressure of at least about 10 MPa;

opening said molding die;

blowing said heated and pressurized washing water on said molding surface of said open molding die; and actuating through a controller said opening and blowing operations.

* * * * *

UNITED STATES PATENT AND TRADEMARK OFFICE

CERTIFICATE OF CORRECTION

PATENT NO. : 6,220,334 B1
DATED : April 24, 2001
INVENTOR(S) : Tomita et al.

It is certified that error appears in the above-identified patent and that said Letters Patent is hereby corrected as shown below:

Column 1,
Line 18, please change "can be cared" to -- can be cured --;
Line 51, please change "convention al" to -- conventional --;
Line 61, please change "therefor e" to -- therefore --;
Line 65, please change "invent ors of the present invention ma de" to -- inventors of the present invention made --;

Column 5,
Line 49, please change "unit or blowing" to -- for blowing --;
Line 60, please change "farther" to -- further --;

Column 6,
Line 51, please change "fi)r" to -- for --;

Column 7,
Line 48, please change " nozzle 9*f* can blow highly Pressurized air" to -- nozzle 9*d* can blow highly pressurized air --.

Signed and Sealed this

Twenty-first Day of May, 2002

*Attest:*

*Attesting Officer*

JAMES E. ROGAN
*Director of the United States Patent and Trademark Office*